US006075493A

United States Patent [19]

Sugawara et al.

[11] Patent Number: 6,075,493

[45] Date of Patent: Jun. 13, 2000

[54] TAPERED SLOT ANTENNA

[75] Inventors: Satoru Sugawara; Koji Mizuno, both of Miyagi, Japan

[73] Assignees: Ricoh Company, Ltd., Tokyo; Koji Mizuno, Sendai, both of Japan

[21] Appl. No.: 09/131,403

[22] Filed: Aug. 10, 1998

[30] Foreign Application Priority Data

Aug. 11, 1997 [JP] Japan ..... 9-216787
Sep. 29, 1997 [JP] Japan ..... 9-264644

[51] Int. Cl.[7] ..... H01Q 13/10

[52] U.S. Cl. ..... 343/767; 343/768; 343/770

[58] Field of Search ..... 343/700 MS, 767, 343/768, 770; 333/110; H01Q 13/10

[56] References Cited

U.S. PATENT DOCUMENTS

| | | | |
|---|---|---|---|
| 3,631,502 | 12/1971 | Leon, Jr. et al. | 343/786 |
| 4,295,142 | 10/1981 | Thiere et al. | 343/781 CA |
| 4,777,457 | 10/1988 | Ghosh et al. | 333/110 |
| 4,905,013 | 2/1990 | Reindel | 343/786 |
| 5,187,489 | 2/1993 | Whelan et al. | 343/767 |
| 5,220,330 | 6/1993 | Salvail et al. | 342/62 |
| 5,519,408 | 5/1996 | Schnetzer | 343/767 |

FOREIGN PATENT DOCUMENTS 5-206724 8/1993 Japan .

5-315833 11/1993 Japan .

OTHER PUBLICATIONS

Ramakrishna Janaswamy, et al., "Analysis of the Tapered Slot Antenna", IEEE Transactions on Antennas and Propagation, vol. AP–35, No. 9, Sep. 1987, pp. 1058–1065.

Satoru Sugawara, et al., "A MM–Wave Tapered Slot Antenna with Improved Radiation Pattern", IEEE MTT–S Digest, WE3F–55, (1997), pp. 959–962.

Satoru Sugawara, et al., "Characteristics of a MM–Wave Tapered Slot Antenna with Corrugated Edges", IEEE MTT–S Digest, WE2A–5, pp. 533–536.

*Primary Examiner*—Hoanganh Le
*Assistant Examiner*—Shih-Chao Chen
*Attorney, Agent, or Firm*—Oblon, Spivak, McClelland, Maier & Neustadt, P.C.

[57] ABSTRACT

A tapered slot antenna includes a dielectric sheet, a conductor layer laminated on said dielectric sheet, in which conductor layer a tapered slot pattern is formed as a result of a slot width of a slotline being widened gradually, and corrugated structures provided at two sides of said conductor layer, parallel to a direction in which an electromagnetic wave is radiated from said antenna. The shape of said antenna is axially asymmetrical.

12 Claims, 13 Drawing Sheets

TAPERED SLOT ANTENNA

BACKGROUND OF THE INVENTION

1. Field of the Invention

The present invention relates to a tapered slot antenna, a tapered-slot-antenna array and a two-dimensional antenna array. In more detail, the present invention relates to a tapered slot antenna, a tapered-slot-antenna array and a two-dimensional antenna array, in which, under a condition where the axis of the antenna extends perpendicular to an end surface of a substrate, on which a surface the aperture of the antenna is present, and the shape of the tapered slot of the antenna is not changed, it is possible to cause the directivity of the antenna to be asymmetrical with respect to the axis of the antenna.

2. Description of the Related Art

A tapered slot antenna has a structure in which a slot width of a slotline widens gradually, and radiates an electromagnetic wave in a direction parallel to the plane of the antenna (the extending direction of the slotline). Further, because the structure of the tapered slot antenna is similar to a slotline, a ground conductor, which is needed for a microstrip line, for example, is not needed on the reverse side of the antenna. Therefore, it is easy to integrate the tapered slot antenna with a feed line or a matching circuit having a uniplanar structure.

Further, there are many cases where a tapered slot antenna is used in combination with an optical element such as a lens. For example, an imaging array using a millimeter wave has been reported.

When a tapered slot antenna is used in combination with an optical element or when a tapered slot antenna is used for a special use such as in a missile or an airplane, there is a case where it is demanded that the direction in which an electromagnetic wave is radiated be different from the front direction of the antenna. As the related art fulfilling such a demand, the antenna in which the axis of the antenna is inclined with respect to the direction perpendicular to the end surface of the substrate on which the antenna aperture is present and the antenna in which the shape of the tapered slot is asymmetric, and so forth, are known.

Examples of an antenna in which the shape of the tapered slot is asymmetric are disclosed in Japanese Laid-Open Patent Application Nos.5-206724 and 5-315833. In each of these examples, the end surface of the substrate on which the antenna aperture is present is oblique, and the shape of the tapered slot is asymmetrical with respect to the direction perpendicular to the end surface of the substrate. Thereby, it is possible to incline the directivity of the antenna with respect to the direction perpendicular to the end surface of the substrate on which the antenna aperture is present.

Further, when the axis of the antenna is inclined with respect to the direction perpendicular to the end surface of the substrate on which the antenna aperture is present, it is necessary to bend a feed line. As a result, a loss in the feed line increases. In particular, when an antenna array is produced using such antennas, it is troublesome to cause the phases of the respective antennas to be identical. Further, because the axis of the antenna is inclined with respect to the direction perpendicular to the end surface of the substrate on which the antenna aperture is present in each antenna, extra spaces are needed when the antennas having different directivity are arranged. As a result, it is not possible to arrange the antennas in close proximity to each other.

Further, the characteristics of the tapered slot antenna depend on the shape of the tapered slot. Therefore, when the shape of the tapered slot of the antenna is caused to be asymmetrical, not only the directivity of the antenna changes but also the gain and reflection property of the antenna greatly change. As a result, it is difficult to design the antenna having the optimum characteristics.

A basic cause of the above-mentioned problems is that it has not been possible to cause the directivity of a tapered slot antenna to be asymmetrical, with the axis of the antenna extending in the direction perpendicular to -he end surface of the substrate on which the antenna aperture is present, without changing the shape of the tapered slot.

SUMMARY OF THE INVENTION

The present invention has been devised in consideration of the above-mentioned points, and an object of the present invention is to provide a tapered slot antenna, a tapered-slot-antenna array and a two-dimensional antenna array, in which it is possible to cause the directivity of the antenna to be asymmetrical, with the axis of the antenna extending in the direction perpendicular to the end surface of the substrate on which the antenna aperture is present, without changing the shape of the tapered slot.

A tapered slot antenna, according to the present invention comprises:

a dielectric sheet;

a conductor layer laminated on said dielectric sheet, in which conductor layer a tapered slot pattern is formed as a result of a slot width of a slotline being widened gradually; and corrugated structures provided at two sides of said conductor layer, parallel to a direction in which an electromagnetic wave is radiated from said antenna, wherein the shape of said antenna is axially asymmetrical.

The corrugated structure on one side may be axially asymmetrical to the corrugated structure on the other side.

One of the inventors of the present invention has found that it is possible to miniaturize an antenna without degradation of the directivity thereof as a result of corrugated structures being formed at the two sides of a conductor layer of a tapered slot antenna, parallel to a direction in which an electromagnetic wave is radiated from the antenna. This matter is disclosed in the prior application Ser. No. 08/870,676 filed on Jun. 6, 1997. The present invention relates to a new knowledge for the corrugated structures obtained from subsequent experiments.

First, the inventors of the present invention have experimentally found that a tapered slot antenna has axially asymmetrical directivity as a result of having axially asymmetrical corrugated structures. Thus, a tapered slot antenna can have asymmetrical directivity under a condition where the front direction of the antenna is perpendicular to the end surface of the substrate on which the aperture of the antenna is present, and the shape of the tapered slot is left axially symmetrical.

One width of the antenna between the axis of the antenna and one edge of the antenna may be axially asymmetrical to the other width of the antenna between the axis of the antenna and the other edge of the antenna.

The authors of *IEEE Transaction on Antennas and Propagation,* Vol. AP-35, No.9, September 1987, pages 1058–1065, "Analysis of the Tapered Slot Antenna," Ramakrishna Janaswamy and Daniel H. Schaubert, point out that the directivity of a tapered slot antenna on the E-plane tends to narrow as a result of the width of the substrate of the tapered slot antenna being narrowed. However, not only does the directivity of the antenna on the E-plane narrow but also side lobe levels of the directivity for each of the E-plane and H-plane increase, and therefore, such an antenna is useless as it is.

The inventors of the present invention have experimentally found that a tapered slot antenna has asymmetrical directivity as a result of having the widths of the substrate narrowed asymmetrically with respect to the axis of the antenna. Thus, a tapered slot antenna can have asymmetrical directivity under a condition where the front direction of the antenna is perpendicular to the end surface of the substrate on which the aperture of the antenna is present, and the shape of the tapered slot is left axially symmetrical. As a result of the corrugated structures being formed in the antenna, the directivity thereof is prevented from being degraded even when the width of the substrate is narrowed.

The corrugated structure on one side may be axially asymmetrical to the corrugated structure on the other side; and also one width of the antenna between the axis of antenna and one edge of the antenna may be axially asymmetrical the other width of the antenna between the axis of the antenna and the other edge of the antenna.

The inventors of the present invention have experimentally found that the antenna has asymmetrical directivity as a result of having the corrugated structures axially asymmetrical and also having one and the other widths of the antenna axially. The one width of the antenna is a width between the axis of the antenna and one edge of the antenna, and the other width of the antenna is a width between the axis of the antenna and the other edge of the antenna. Thus, a tapered slot antenna can have asymmetrical directivity under a condition where the front direction of the antenna is perpendicular to the end surface of the substrate on which the aperture of the antenna is present, and the shape of the tapered slot is left axially symmetrical.

A tapered-slot-antenna array, according to another aspect of the present invention, comprises an array of a plurality of tapered slot antennas provided in the same dielectric substrate, the array comprising:

a dielectric sheet;

a conductor layer laminated on the dielectric sheet, wherein tapered slot patterns are formed in the conductor layer as a result of slot widths of slotlines being widened gradually for the plurality of tapered slot antennas, respectively; and corrugated structures provided at two sides of a portion of the conductor layer, for at least one of the plurality of tapered slot antennas, parallel to a direction in which an electromagnetic wave is radiated from the at least one of the plurality of tapered slot antennas, wherein the shape of the at least one of the plurality of tapered slot antennas is axially asymmetrical.

Thus, an antenna array includes at least a tapered slot antenna having asymmetrical directivity, and further, it is preferable that the antenna array includes a tapered slot antenna having symmetrical directivity at the central position of the antenna array as described later. Thus, it is possible to provide an appropriate antenna array under a condition where the front direction of the antenna is perpendicular to the end surface of the substrate on which the aperture of the antenna is present, and the shape of the tapered slot is left axially symmetrical.

A distance between the axes of each pair of adjacent ones of the plurality of tapered slot antennas may be equal.

When a tapered-slot-antenna array is used as an imaging array, it is preferable to arrange tapered slot antennas with an equal pitch. Thereby, it is possible to obtain maximum resolution, and the tapered-slot-antenna array according to the present invention is suitable to be used as an imaging array.

The directivity of each of the tapered slot antennas, of the plurality of tapered slot antennas, other than the tapered slot antenna located at the central position of the tapered-slot-antenna array, may have a gain distribution extending in a direction inclined to the center of the tapered-slot-antenna array.

When a tapered-slot-antenna array is used as an imaging array, it is preferable to cause each tapered slot antenna to have a directivity having a gain distribution extending in a direction toward the center of an optical element. As a result of the directivity of each of the tapered slot antennas, of the plurality of tapered slot antennas, other than the tapered slot antenna located at the central position of the tapered-slot-antenna array, having a gain distribution extending in a direction inclined to the center of the tapered-slot-antenna array, degradation of the vignetting factor can be prevented at the periphery of the array. Therefore, the tapered-slot-antenna array according to the present invention is suitable to be used as an imaging array.

A two-dimensional antenna array, according to another aspect of the present invention, comprises a plurality of tapered-slot-antenna arrays provided to a substrate, wherein:

each of the plurality of tapered-slot-antenna arrays comprises an array of a plurality of tapered slot antennas and extends in a direction perpendicular to the substrate;

the array of the plurality of tapered slot antennas comprising:

a dielectric sheet, a conductor layer laminated on the dielectric sheet, in which conductor layer tapered slot patterns are formed as a result of slot widths of slotlines being widened gradually for the plurality of tapered slot antennas, respectively, and corrugated structures provided at two sides of a portion of the conductor layer, for at least one of the plurality of tapered slot antennas, parallel to a direction in which an electromagnetic wave is radiated from the at least one of the plurality of tapered slot antennas, the shape of the at least one of the plurality of tapered slot antennas being axially asymmetrical;

the directivity of the tapered-slot-antenna array provided at the central position of the two-dimensional antenna array has a gain distribution extending in a front direction of the two-dimensional antenna array; and the directivity of each of the other tapered-slot-antenna arrays of the plurality of tapered-slot-antenna arrays has a gain distribution extending in a direction inclined to the center of the two-dimensional antenna array.

When a two-dimensional antenna array is used as a two-dimensional imaging array, it is preferable that the directivity of each tapered-slot-antenna array has a gain distribution extending in a direction toward the center of an optical element. As a result of causing the front direction of each tapered-slot-antenna array to be a direction toward the center of the optical element, for example, degradation of the vignetting factor can be prevented at the periphery of the array. Therefore, the two-dimensional antenna array according to the present invention is suitable to be used as a two-dimensional imaging array.

A tapered-slot-antenna array, according to another aspect of the present invention, comprises:

a first tapered slot antenna, comprising:

a dielectric sheet, a conductor layer laminated on the dielectric sheet, in which conductor layer a tapered slot pattern is formed as a result of a slot width of a slotline being widened gradually, and corrugated structures provided at two sides of the conductor layer, parallel to a direction in which an electromagnetic wave is radiated from the antenna, wherein the shape of the antenna is axially asymmetrical; and a second tapered slot antenna, comprising:

a dielectric sheet, a conductor layer laminated on the dielectric sheet, in which conductor layer a tapered slot pattern is formed as a result of a slot width of a slotline being widened gradually, and corrugated structures provided at two sides of the conductor layer, parallel to a direction in which an electromagnetic wave is radiated from the antenna, wherein the shape of the antenna is axially symmetrical.

As a result of an array including a tapered slot antenna having symmetrical directivity at the center thereof and tapered slot antennas each having asymmetrical directivity adjacent to the central tapered slot antenna, it is possible to provide an appropriate antenna array under a condition where, in each antenna, the front direction of the antenna is perpendicular to the end surface of the substrate on which the aperture of the antenna is present, and the shape of the tapered slot pattern is left axially symmetrical.

The distance between the axes of each pair of adjacent ones of the tapered slot antennas may be equal.

When a tapered-slot-antenna array is used as an imaging array, it is preferable to arrange tapered slot antennas with an equal pitch. Thereby, it is possible to obtain maximum resolution. Therefore, the tapered-slot-antenna array according to the present invention is suitable to be used as an imaging array.

A tapered-slot-antenna array, according to another aspect of the present invention, comprises an array of a plurality of tapered slot antennas, wherein:

the tapered slot antenna positioned at the center of the plurality of tapered slot antenna arrays comprises:

a dielectric sheet, a conductor layer laminated on the dielectric sheet, in which conductor layer a tapered slot pattern is formed as a result of a slot width of a slotline being widened gradually, and corrugated structures provided at two sides of the conductor layer, parallel to a direction in which an electromagnetic wave is radiated from the antenna, wherein the shape of the antenna is axially symmetrical, and thereby, the directivity of the antenna is axially symmetrical; and each of the other tapered slot antennas of the plurality of tapered slot antennas comprises:

a dielectric sheet, a conductor layer laminated or the dielectric sheet, in which conductor layer a tapered slot pattern is formed as a result of a slot width of a slotline being widened gradually, and corrugated structures provided at two sides of the conductor layer, parallel to a direction in which an electromagnetic wave is radiated from the antenna, wherein the shape of the antenna is axially asymmetrical, and thereby, the directivity of the antenna is axially asymmetrical and has a gain distribution extending in a direction inclined to the center of the tapered-slot-antenna array.

When a tapered-slot-antenna array is used as an imaging array, it is preferable to cause each tapered slot antenna to have a directivity having a gain distribution extending in a direction to the center of an optical element. As a result of the directivity of each of the tapered slot antennas, of the plurality of tapered slot antennas, other than the tapered slot antenna located at the central position of the tapered-slot-antenna array, having a gain distribution extending in a direction inclined to the center of the tapered-slot-antenna array, and also, the directivity of the central tapered slot antenna having a gain distribution extending in the front direction of the tapered-slot-antenna array, degradation of the vignetting factor can be prevented at the periphery of the array. Therefore, the tapered-slot-antenna array according to the present invention is suitable to be used as an imaging array.

A two-dimensional antenna array, according to another aspect of the present invention, comprises a plurality of tapered-slot-antenna arrays provided to a substrate, wherein:

each of the plurality of tapered-slot-antenna arrays comprises an array of a plurality of tapered slot antennas and extends in a direction perpendicular to the substrate;

the array of the plurality of tapered slot antennas comprising:

a dielectric sheet, a conductor layer laminated on the dielectric sheet, in which conductor layer tapered slot patterns are formed as a result of slot widths of slotlines being widened gradually, for the plurality of tapered slot antennas, respectively, and corrugated structures provided at two sides of a portion of the conductor layer for each of the plurality of tapered slot antennas, parallel to a direction in which an electromagnetic wave is radiated from the tapered slot antenna, the shape of at least one of the plurality of tapered slot antennas being axially asymmetrical, and the shape of another of the plurality of tapered slot antennas being axially symmetrical;

the directivity of the tapered-slot-antenna array provided at the central position of the two-dimensional antenna array has a gain distribution extending in the front direction of the two-dimensional antenna array; and the directivity of each of the other tapered-slot-antenna arrays of the plurality of tapered-slot-antenna arrays has a gain distribution in a direction inclined to the center of the two-dimensional antenna array.

When a two-dimensional antenna array is used as a two-dimensional imaging array, it is preferable that the directivity of each tapered-slot-antenna array has a gain distribution extending in a direction toward the center of an optical element. As a result of causing the front direction of each tapered-slot-antenna array to be a direction toward the center of the optical element, for example, degradation of the vignetting factor can be prevented at the periphery of the array. Therefore, the two-dimensional antenna array according to the present invention is suitable to be used as a two-dimensional imaging array.

Other objects and further features of the present invention will become more apparent from the following detailed description when read in conjunction with the accompanying drawings.

DETAILED DESCRIPTION OF THE PREFERRED EMBODIMENTS

Embodiments of the present invention will now be described with reference to the figures.

Figure 1:
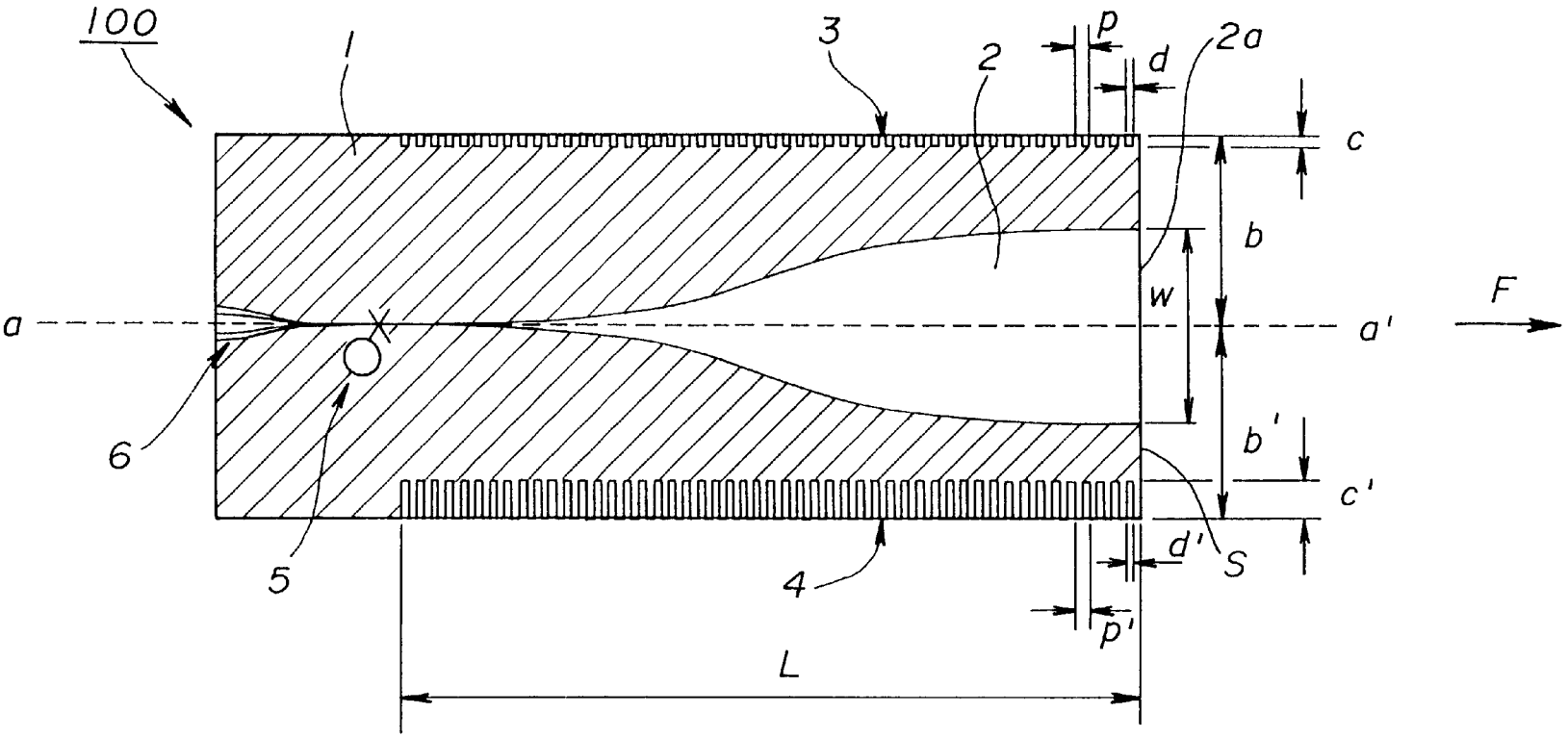
FIG. 1 shows a plan view of a tapered slot antenna in a first embodiment of the present invention.

FIG. 1 shows a plan view of a tapered slot antenna 100 in a first embodiment of the present invention. The antenna is formed in a dielectric substrate 1. The dielectric substrate 1 includes a sheet of Kapton (trade name of DuPont (E. I. du pont de Nemours and Company (Inc.)) of the United States) having a thickness of 50 $\mu$m and a layer of copper having a thickness of 5 $\mu$m laminated on the Kapton sheet. A tapered slot pattern 2 is formed in the copper layer as a result of the cooper layer being partially eliminated (as shown in FIG. 1 of the above-mentioned prior application Ser. No. 08/870,676). An antenna aperture 2*a* is located at the extending end of the tapered slot pattern 2. The design frequency of the antenna is 60 GHz, the antenna length (L, shown in the figure) is 20 mm, and the aperture width (W shown in the figure) is 5 mm.

The tapered slot antenna 100 has corrugated structures 3 and 4. In the corrugated structures (as shown in FIG. 18 of the above-mentioned prior application Ser. No. 08/870,676), the copper layer is eliminated periodically rectangularly at the two sides of the dielectric substrate 1. In the corrugated structure 3, rectangular slits each having a 0.2-mm width (d, shown in the figure) by a 0.3-mm length (c, shown in the figure) are arranged with a period (p, shown in the figure) of 0.4 mm. In the corrugated structure 4, rectangular slits each having a 0.2-mm width (d') by a 1-mm length (c') are arranged with a period (p') of 0.4 mm. A balun 5 is provided for converting a mode for a feed line 6 of CPW (Coplanar Waveguide). With regard to the balun, see "A mm-Wave Tapered Slot Antenna with Improved Radiation Pattern," written by Satoru Sugawara et al. (1997 *IEEE MTT-S Digest,* WE3F-55, pages 959–960, 'Double Y Balun').

In the first embodiment, with respect to the axis a–a' of the antenna 100, the shape of the tapered slot 2 is symmetrical, and the widths b, b' of the antenna 100 are symmetrical (b=b'=5 mm). However, the length c of the rectangular slits of the corrugated structure 3 is axially asymmetrical to the length c' of the rectangular slits of the corrugated structure 4 (c=0.3 mm, c'=1 mm). Further, the axis a–a' of the antenna 100 is perpendicular to the end surface S of the dielectric substrate 1 on which the aperture 2*a* is present.

Figure 2B:
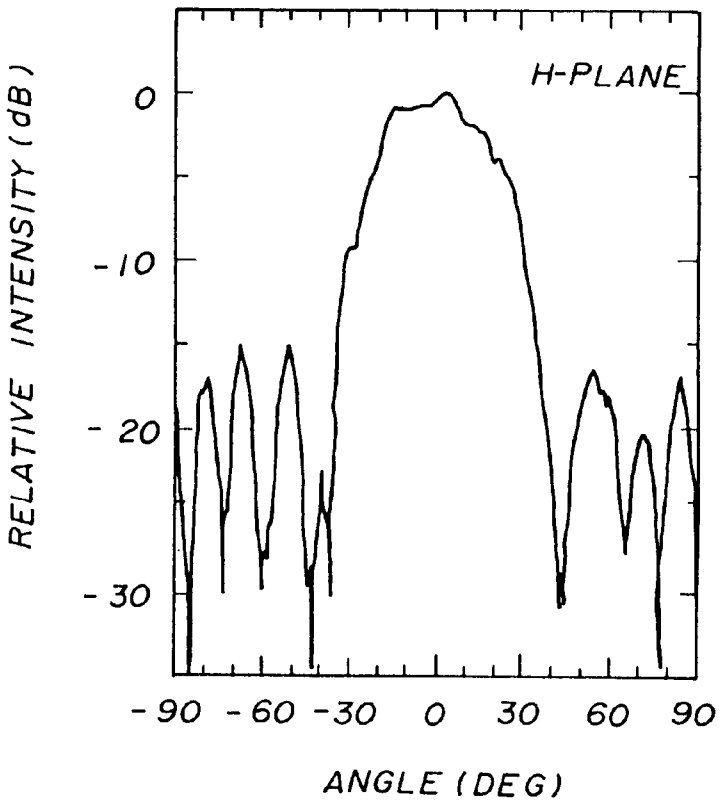
FIGS. 2A and 2B are graphs showing a result of measuring the directivity of the tapered slot antenna shown in FIG. 1 at 60 GHz.
Figure 2A:
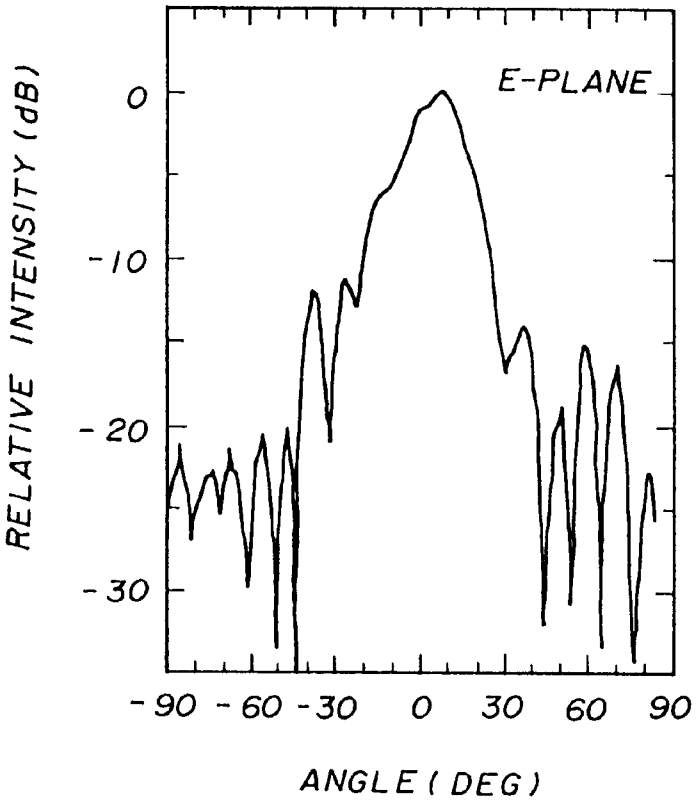

FIGS. 2A and 2B are graphs showing results of measurements of the directivity of the tapered slot antenna 100 shown in FIG. 1 at 60 GHz. As the results of the measurement, good directivity is obtained wherein side lobe levels are low for each of the E-plane (FIG. 2A) and the H-plane (FIG. 2B). Further, for the E-plane, asymmetrical directivity with respect to the front direction (F, shown in FIG. 1) of the antenna 100 is obtained. This indicates effectiveness of the antenna 100 according to the present invention.

Figure 3:
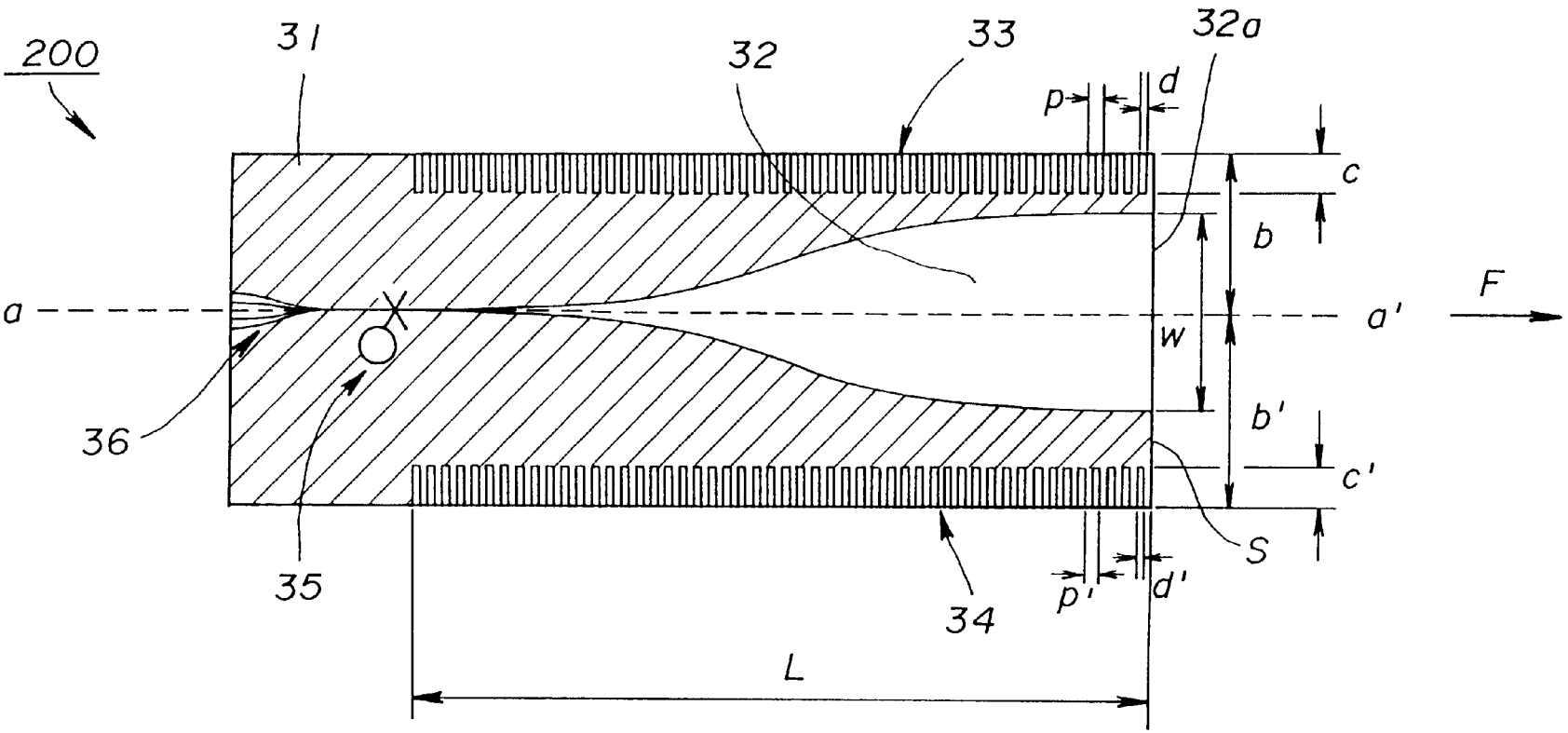
FIG. 3 shows a plan view of a tapered slot antenna in a second embodiment of the present invention.

FIG. 3 shows a plan view of a tapered slot antenna 200 in a second embodiment of the present invention. The antenna is formed in a dielectric substrate 31. The dielectric substrate 31 includes a sheet of Kapton having a thickness of 50 $\mu$m and a layer of copper having a thickness of 5 $\mu$m laminated on the Kapton sheet. A tapered slot pattern 32 is formed as a result of the copper layer being partially eliminated (as shown in FIG. 1 of the above-mentioned prior application Ser. No. 08/870,676). An antenna aperture 32*a* is located at the extending end of the tapered slot pattern 32. The design frequency of the antenna 200 is 60 GHz, the antenna length (L) is 20 mm, and the aperture width (W) is 5 mm.

The tapered slot antenna 200 has corrugated structures 33 and 34. In the corrugated structures 33 and 34 (as shown in FIG. 18 of the above-mentioned prior application Ser. No. 08/870,676), the copper layer is eliminated periodically rectangularly at the two sides of the dielectric substrate 31. In each of the corrugated structures 33 and 34, rectangular slits each having a 0.2-mm width (d, d') by a 1-mm length (c, c') are arranged with a period (p, p') of 0.4 mm. A balun 35 is provided for converting a mode for a feed line 36 of CPW (Coplanar Waveguide). With regard to the balun, see "A mm-Wave Tapered Slot Antenna with Improved Radiation Pattern," written by Satoru Sugawara et al. (1997 *IEEE MTT-S Digest,* WE3F-55, pages 959–960, 'Double Y Balun').

In the second embodiment, with respect to the axis a–a' of the antenna 200, the shape of the tapered slot pattern 32 is symmetrical, but the widths b, b' of the antenna 200 are asymmetrical (b=4 mm, b'=5 mm). The length c of the rectangular slits of the corrugated structure 33 is axially symmetrical to the length c' of the rectangular slits of the corrugated structure 34 (c=c'=1 mm). Further, the axis a–a' of the antenna 200 is perpendicular to the end surface S of the dielectric substrate 31 on which the aperture 32*a* is present.

Figure 4B:
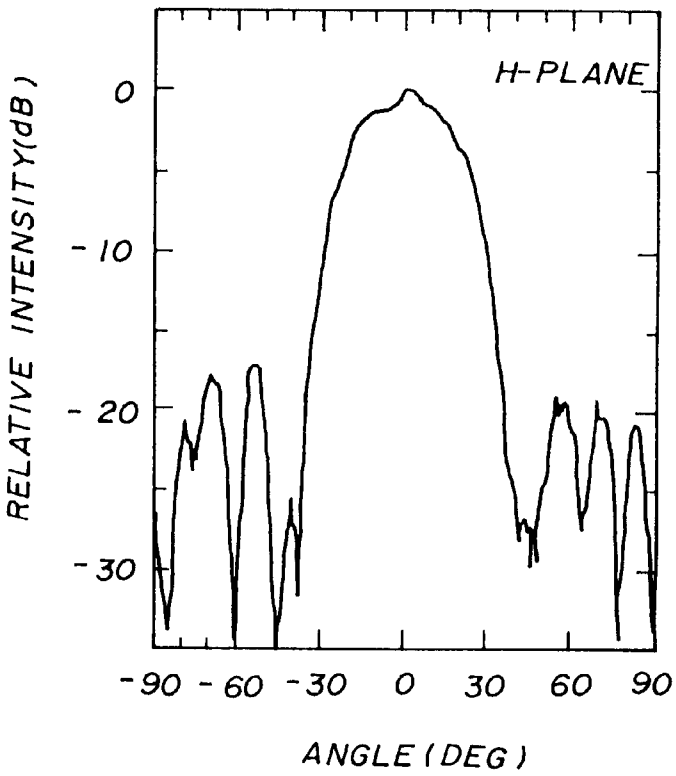
FIGS. 4A and 4B are graphs showing a result of measuring the directivity of the tapered slot antenna shown in FIG. 3 at 60 GHz.
Figure 4A:
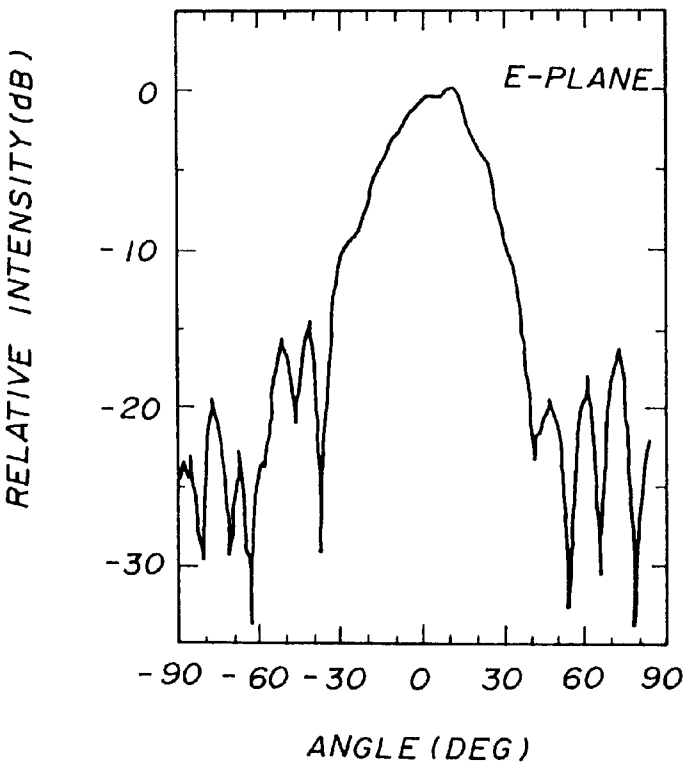

FIGS. 4A and 4B are graphs showing results of measurements of the directivity of the tapered slot antenna 200 shown in FIG. 3 at 60 GHz. As the results of the measurement, good directivity is obtained wherein side lobe levels are low for each of the E-plane (FIG. 4A) and the H-plane (FIG. 4B). Further, for the E-plane, asymmetrical directivity with respect to the front direction (F) of the antenna 200 is obtained. This indicates effectiveness of the antenna 200 according to the present invention.

Figure 5:
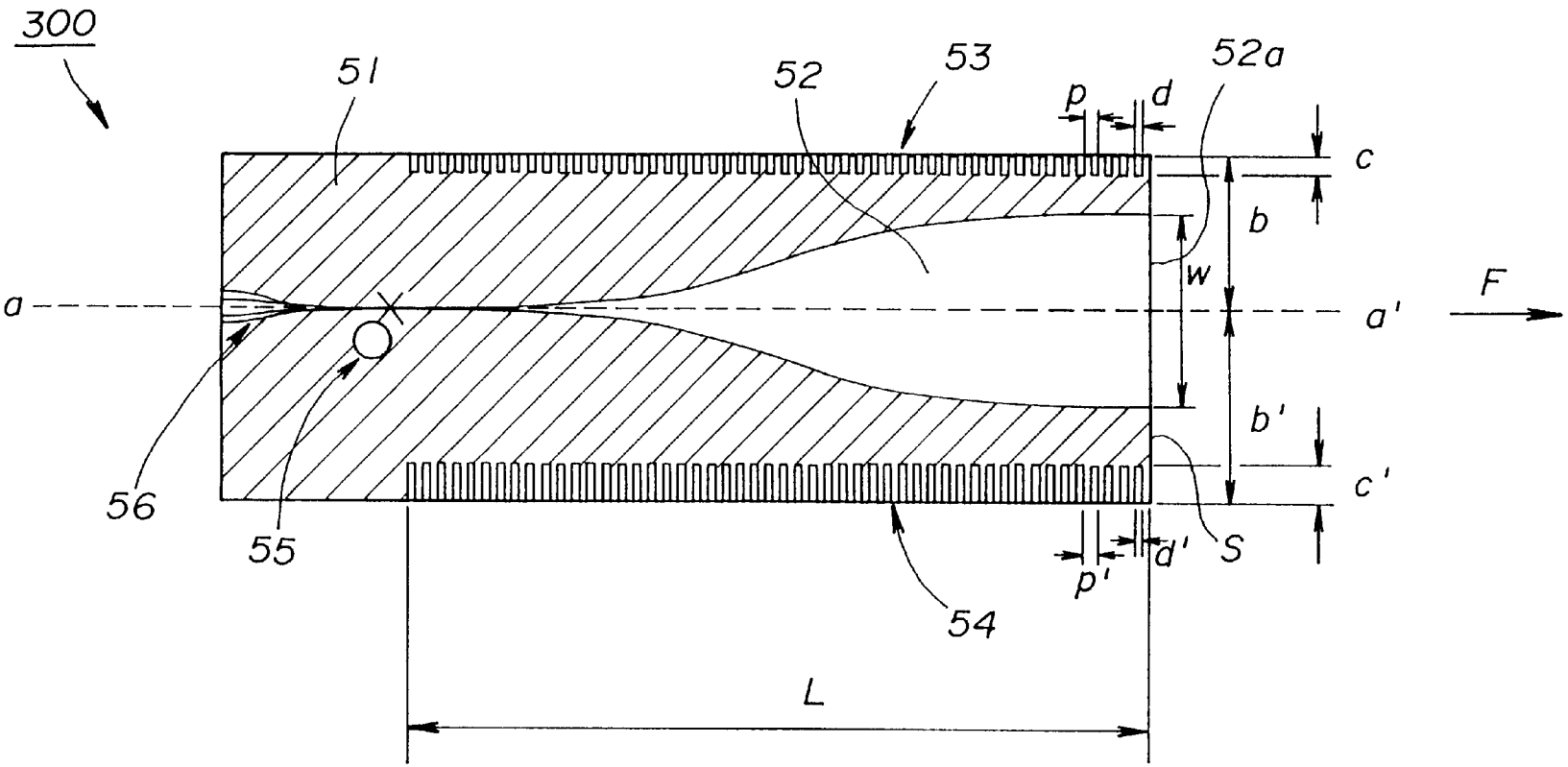
FIG. 5 shows a plan view of a tapered slot antenna in a third embodiment of the present invention.

FIG. 5 shows a plan view of a tapered slot antenna 300 in a third embodiment of the present invention. The antenna 300 is formed in a dielectric substrate 51. The dielectric substrate 51 includes a sheet of Kapton having a thickness of 50 $\mu$m and a layer of copper having a thickness of 5 $\mu$m laminated on the Kapton sheet. A tapered slot pattern 52 is formed as a result of the copper layer being partially eliminated (as shown in FIG. 1 of the above-mentioned prior application Ser. No. 08/870,676). An antenna aperture 52*a* is located at the end of the tapered slot pattern 52. The design frequency of the antenna is 60 GHz, the antenna length (L) is 20 mm, and the aperture width (W) is 5 mm.

The tapered slot antenna 300 has corrugated structures 53 and 54. In the corrugated structures 53 and 54 (as shown in FIG. 18 of the above-mentioned prior application Ser. No. 08/870,676), the copper layer is eliminated periodically rectangularly at the two sides of the dielectric substrate 51. In the corrugated structure 53, rectangular slits each having a 0.2-mm width (d, shown in the figure) by a 0.5-mm length (c, shown in the figure) are arranged with a period (p, shown in the figure) of 0.4 mm. In the corrugated structure 54, rectangular slits each having a 0.2-mm width (d') by a 1-mm length (c') are arranged with a period (p') of 0.4 mm. A balun 55 is provided for converting a mode for a feed line 56 of CPW (Coplanar Waveguide). With regard to the balun, see "A mm-Wave Tapered Slot Antenna with Improved Radiation Pattern," written by Satoru Sugawara et al. (1997 *IEEE MTT-S Digest,* WE3F-55, pages 959–960, 'Double Y Balun').

In the third embodiment, with respect to the axis a–a' of the antenna 300, the shape of the tapered slot pattern 52 is symmetrical, but the widths b, b' of the antenna 300 are asymmetrical (b=4 mm, b'=5 mm). The length c of the rectangular slits of the corrugated structure 53 is axially asymmetrical to the length c' of the rectangular slits of the corrugated structure 54 (c=0.5 mm, c'=1 mm). Further, the axis a–a' of the antenna 300 is perpendicular to the end surface S of the dielectric substrate 51 on which the aperture 52*a* is present.

Figure 6B:
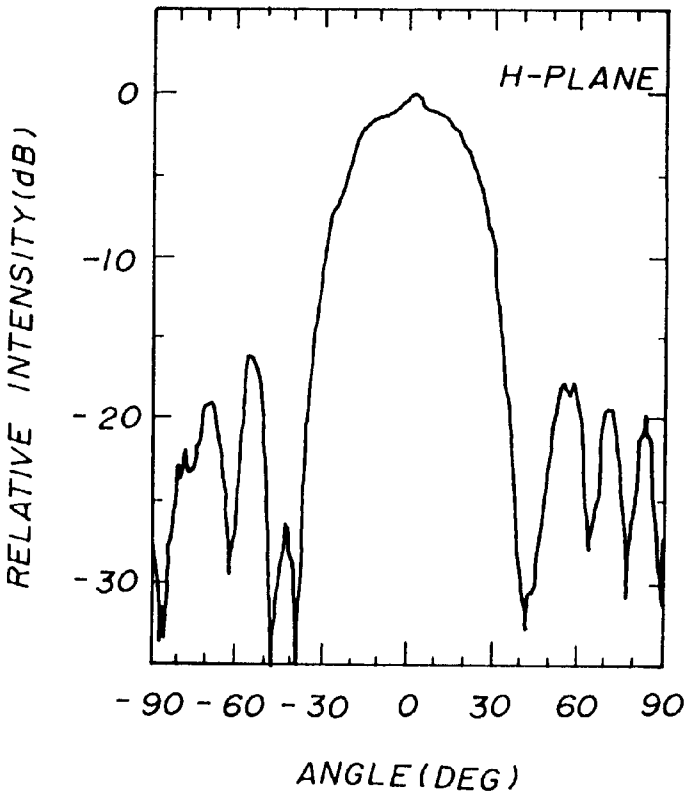
FIGS. 6A and 6B are graphs showing a result of measuring the directivity of the tapered slot antenna shown in FIG. 5 at 60 GHz.
Figure 6A:
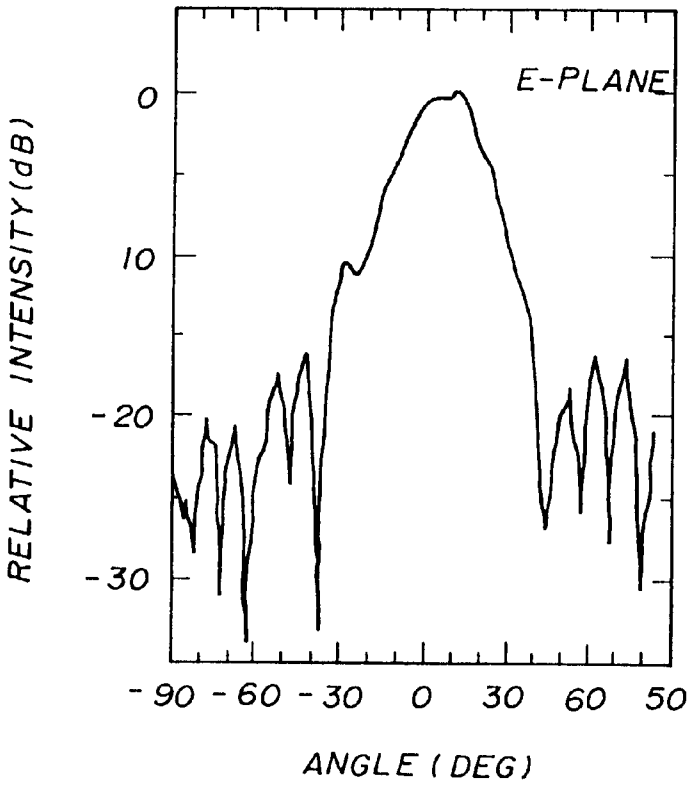

FIGS. 6A and 6B are graphs showing results of measurements of the directivity of the tapered slot antenna 300 shown in FIG. 5 at 60 GHz. As the results of the measurement, good directivity is obtained wherein side lobe levels are low for each of the E-plane (FIG. 6A) and the H-plane (FIG. 6B). Further, for the E-plane, asymmetrical directivity with respect to the front direction (F) of the antenna is obtained. This indicates effectiveness of the antenna according to the present invention.

Figure 7:
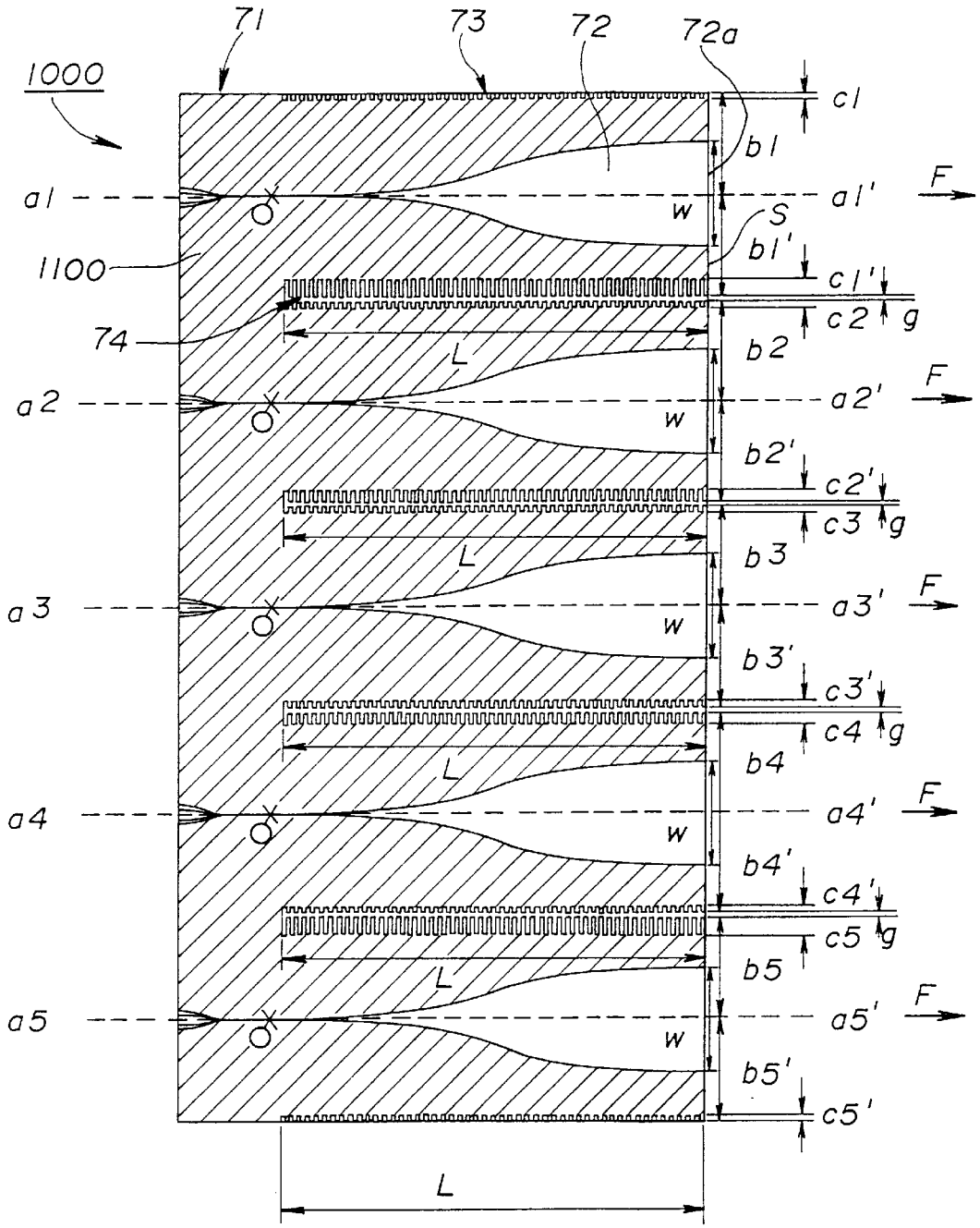
FIG. 7 shows a plan view of a tapered-slot-antenna array in a fourth embodiment of the present invention.

FIG. 7 shows a plan view of a tapered-slot-antenna array in a fourth embodiment of the present invention. This tapered-slot-antenna array 1000 is formed as a result of tapered slot antennas 1100 being arranged with an equal pitch. That is, the distance between the axes a1–a1', a2–a2' of the adjacent antennas, the distance between the axes a2–a2', a3–a3' of the adjacent antennas, the distance between the axes a3–a3', a4–a4' of the adjacent antennas, and the distance between the axes a4–a4', a5–a5' of the adjacent antennas are equal to each other. The antennas 1100 of the array 1000 are formed in a dielectric substrate 71. The dielectric substrate 71 includes a sheet of Kapton having a thickness of 50 $\mu$m and a layer of copper having a thickness of 5 $\mu$m laminated on the Kapton sheet. A tapered slot pattern 72 of each antenna 1100 is formed as a result of the copper layer being partially eliminated (as shown in FIG. 1 of the above-mentioned prior application Ser. No. 08/870,676). An antenna aperture 72*a* is located at the end of the tapered slot pattern 72. The design frequency of the antenna 1100 is 60 GHz, the antenna length (L) is 20 mm, and the aperture width (W) is 5 mm. In each antenna 1100, the tapered slot pattern 72 is symmetrical with respect to a respective one of the axes a1–a1', a2–a2', a3–a3', a4–a4' and a5–a5'. Further, the axes a1–a1', a2–a2', a3–a3', a4–a4' and a5–a5' are parallel to each other and perpendicular to the end surface S of the dielectric substrate 71 on which the apertures 72*a* are present. Further, the front directions (F) of the respective antennas 1100 are the same as each other.

Each tapered slot antenna 1100 has corrugated structures 73 and 74. In the corrugated structures 73 and 74 (as shown in FIG. 18 of the above-mentioned prior application Ser. No. 08/870,676), the copper layer is eliminated periodically rectangularly at the two sides of the tapered slot antenna 1100.

In each tapered slot antenna 1100, the widths b1, b1' of the antenna are symmetrical with respect to the axis a1–a1' of the antenna, the widths b2, b2' of the antenna are symmetrical with respect to the axis a2–a2' of the antenna, the widths b3, b3' of the antenna are symmetrical with respect to the axis a3–a3' of the antenna, the widths b4, b4' of the antenna are symmetrical with respect to the axis a4–a4' of the antenna and the widths b5, b5' of the antenna are symmetrical with respect to the axis a5–a5' of the antenna. The length (c3) of the rectangular slits of the corrugated structure 73 is symmetrical to the length (c3') of the rectangular slits of the corrugated structure 74 in the antenna positioned at the center of the tapered-slot-antenna array 1000, while the length (c1, c2, c4 or c5) of the rectangular slits of the corrugated structure 73 is axially asymmetrical to the length (c1', c2', c4' or c5') of the rectangular slits of the corrugated structure 74 in each of the other antennas so that the antenna has the gain distribution extending in a direction inclined to the center of the array 1000. Specifically, the antenna widths are such that b1=b1'=b2=b2'=b3=b3'=b4=b4'=b5=b5'=5 mm. The lengths of the rectangular slits of the corrugated structures 73, 74 are such that c1=0.3 mm, c1'=1 mm, c2=0.3 mm, c2'=0.6 mm, c3=c3'=0.3 mm, c4=0.6 mm, c4'=0.3 mm, c5=1 mm, and c5'=0.3 mm.

As shown in FIG. 7, a gap (g, shown in the figure) is formed between the corrugated structures 74, 73 of each pair of adjacent antennas. The gaps (g) are provided in order to prevent the corrugated structures 74, 73 of each pair of adjacent antennas from being electrically connected with one another. Each gap has a distance on the order of 100 $\mu$m.

As a variant embodiment of the fourth embodiment, it is possible that a tapered-slot-antenna array includes only tapered slot antennas, each having the asymmetrical directivity, and does not include a tapered slot antenna such as the antenna positioned at the center of the array 1000 of the fourth embodiment which has the symmetrical directivity.

Figure 8:
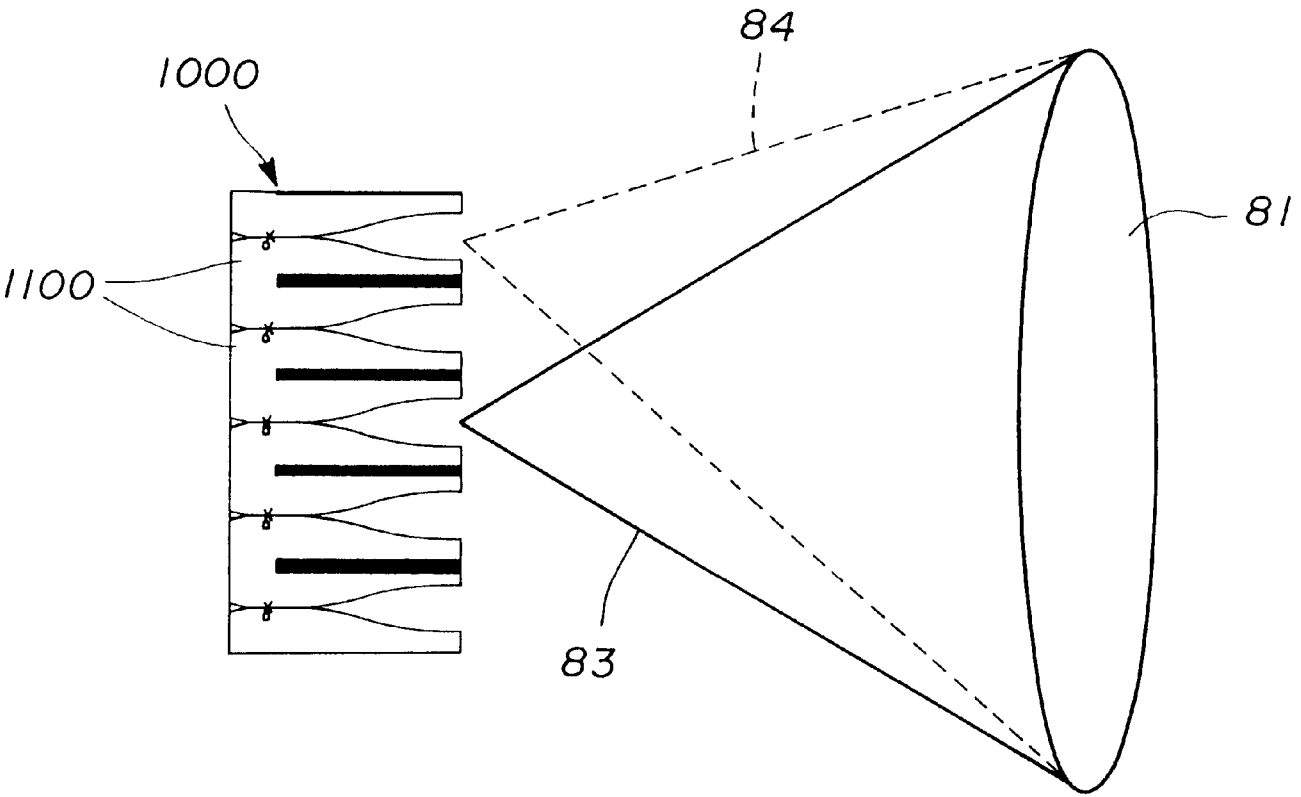
FIG. 8 shows a general arrangement of an example of a combination of the tapered-slot-antenna array shown in FIG. 7 and an optical element.

FIG. 8 shows a general arrangement of an example in which the tapered-slot-antenna array 1000 shown in FIG. 7 is combined with an optical element 81. As shown in the figure, the directivity 83 of the tapered slot antenna 1100 located at the center of the tapered-slot-antenna array 1000 is controlled to have a maximum gain in the front direction of the tapered slot antenna 1100. On the other hand, the directivity of each of the other tapered slot antennas 1100 is controlled so as to have a maximum gain in a direction inclined to the center of the tapered-slot-antenna array 1000. For example, the directivity 84 of the tapered slot antenna 1100 located at a periphery of the tapered-slot-antenna array 1000 is controlled so as to have the maximum gain in a direction inclined to the center of the tapered-slot-antenna array 1000.

Figure 9:
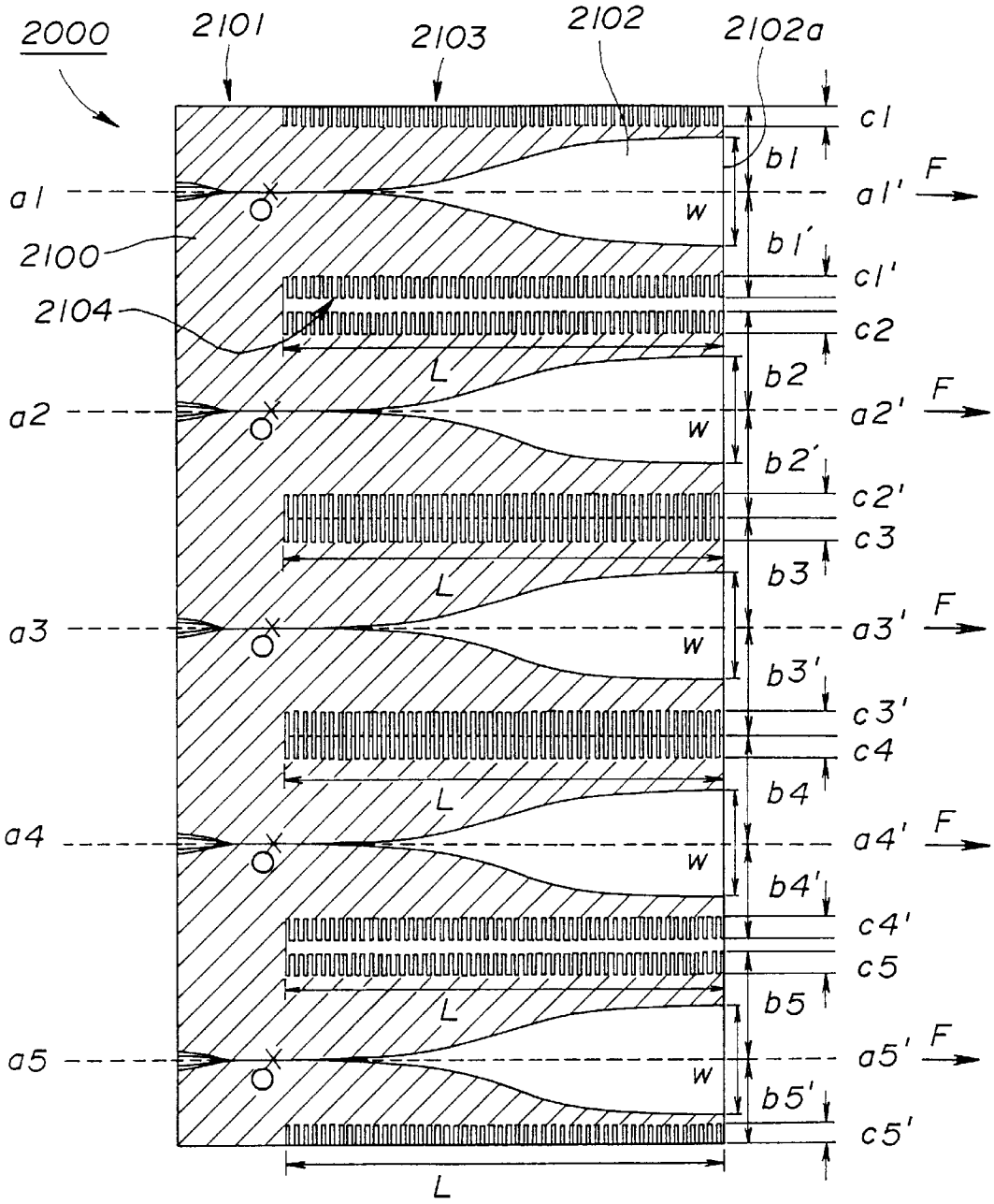
FIG. 9 shows a plan view of a tapered-slot-antenna array in a fifth embodiment of the present invention.

FIG. 9 shows a plan view of a tapered-slot-antenna array in a fifth embodiment of the present invention. This tapered-slot-antenna array 2000 is formed as a result of tapered slot antennas 2100 being arranged with an equal pitch. That is, the distance between the axes a1–a1', a2–a2' of the adjacent antennas, the distance between the axes a2–a2', a3–a3' of the adjacent antennas, the distance between the axes a3–a3', a4–a4' of the adjacent antennas, and the distance between the axes a4–a4', a5–a5' of the adjacent antennas are equal to each other. The antennas 2100 of the array 2000 are formed in a dielectric substrate 2101. The dielectric substrate 2101 includes a sheet of Kapton having a thickness of 50 $\mu$m and a layer of copper having a thickness of 5 $\mu$m laminated on the Kapton sheet. A tapered slot pattern 2102 of each antenna 2100 is formed as a result of the copper layer being partially eliminated (as shown in FIG. 1 of the above-mentioned prior application Ser. No. 08/870,676). An antenna aperture 2102*a* is located at the end of the tapered slot pattern 2102. The design frequency of the antenna is 60 GHz, the antenna length (L) is 20 mm, and the aperture width (W) is 5 mm. In each antenna 2100, the tapered slot pattern 2102 is symmetrical with respect to a respective one of the axes a1–a1', a2–a2', a3–a3', a4–a4' and a5–a5'. Further, the axes a1–a1', a2–a2', a3–a3', a4–a4' and a5–a5' are parallel to each other and perpendicular to the end surface S of the dielectric substrate 2101 on which the apertures 2102*a* are present. Further, the front directions (F) of the respective antennas 2100 are the same as each other.

Each tapered slot antenna 2100 has corrugated structures 2103 and 2104. In the corrugated structures (as shown in FIG. 18 of the above-mentioned prior application Ser. No. 08/870,676), the copper layer is eliminated periodically rectangularly at the two sides of the tapered-slot antenna 2100.

In the respective antennas 2100, the widths b3, b3' of the central antenna 2100 are symmetrical with respect to the axis a3–a3' of the antenna positioned at the center of the array 2000, while in each of the other antennas, respective ones of the widths b1, b1', the widths b2, b2'. the widths b4, b4', and the widths b5, b5' are assymmetrical with respect to a respective one of the axes a1–a1', a2–a2', a4–a4' and a5–a5' so that the antenna has a gain distribution extending in a direction inclined to the center of the array 2000. In the respective antennas 2100, the length c1 of the rectangular slits of the corrugated structure 2103 is axially symmetrical to the length c1' of the rectangular slits of the corrugated structure 2104, the length c2 of the rectangular slits of the corrugated structure 2103 is axially symmetrical to the length c2' of the rectangular slits of the corrugated structure 2104, the length c3 of the rectangular slits of the corrugated structure 2103 is axially symmetrical to the length c3' of the rectangular slits of the corrugated structure 2104, the length c4 of the rectangular slits of the corrugated structure 2103 is axially symmetrical to the length c4' of the rectangular slits of the corrugated structure 2104, and the length c5 of the rectangular slits of the corrugated structure 2103 is axially symmetrical to the length c5' of the rectangular slits of the corrugated structure 2104. Specifically, the antenna widths are such that b1=4 mm, b1'=5 mm, b2=4.5 mm, b2'=5 mm, b3=5 mm, b3'=5 mm, b4=5 mm, b4'=4.5 mm, b5=5 mm, and b5'=4 mm. The lengths of the rectangular slits of the corrugated structures 73, 74 are such that c1=c1'=c2=c2'=c3=c3'=c4=c4'=c5=c5'=1 mm.

Although each of the corrugated structures formed at the two sides of the antenna 2100 located at the center of the array 2000 seems to be in contact with the corrugated structure of a respective one of the two adjacent antennas 2100 in FIG. 9, each of the corrugated structures formed at the two sides of the antenna 2100 located at the center of the array 2000 is apart from the corrugated structure of a respective one of the two adjacent antennas 2100 by a distance on the order of 100 $\mu$m, actually. Thus, each of the corrugate structures formed at the two sides of the antenna 2100 located at the center of the array 2000 is prevented from being electrically connected with the corrugated structure of a respective one of the two adjacent antennas 2100.

Figure 10:
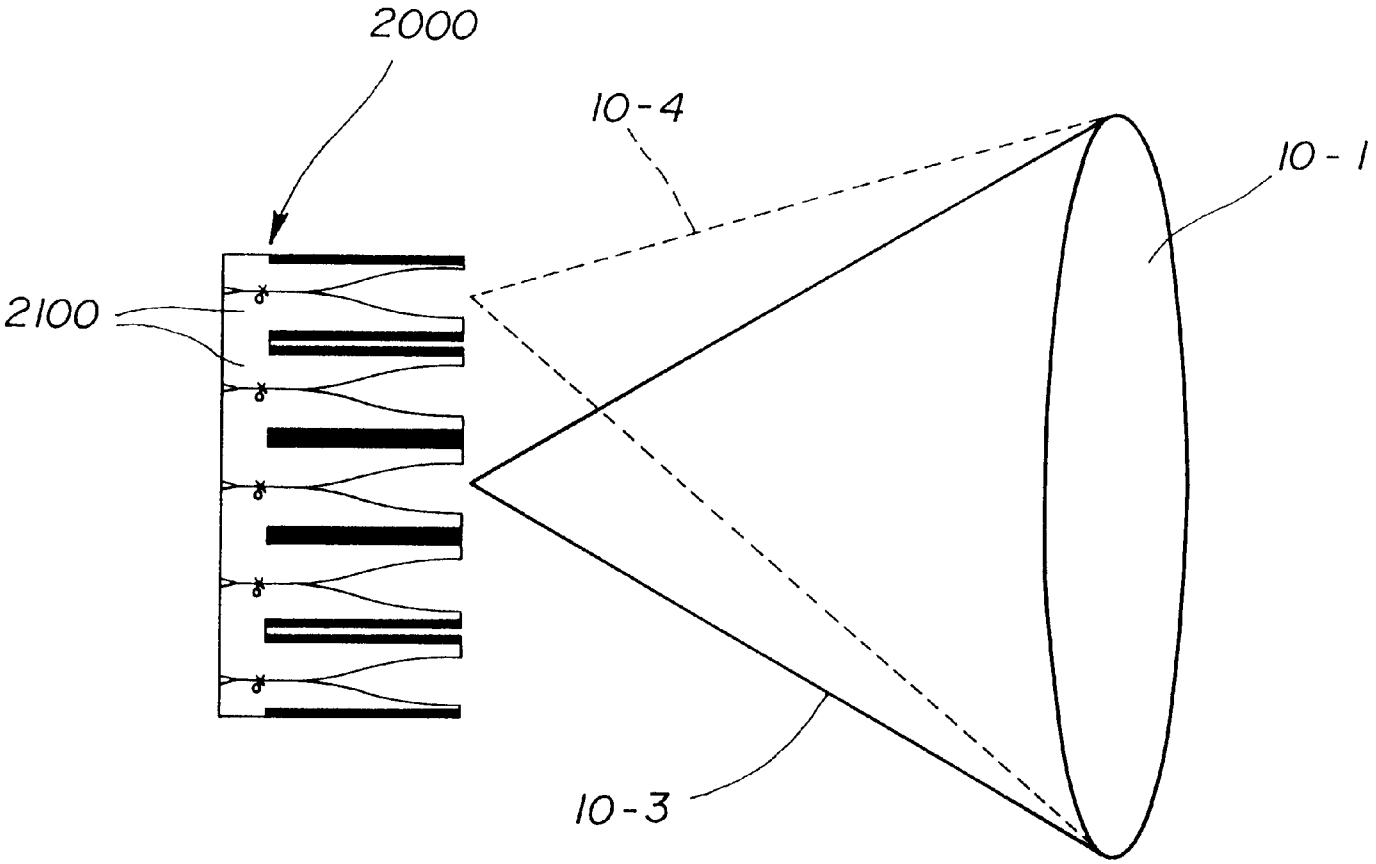
FIG. 10 shows a general arrangement of an example of a combination of the tapered-slot-antenna array shown in FIG. 9 and an optical element.

FIG. 10 shows a general arrangement of an example in which the tapered-slot-antenna array 2000 shown in FIG. 9 is combined with an optical element 10-1. As shown in the figure, the directivity 10-3 of the tapered slot antenna 2100 located at the center of the tapered-slot-antenna array 2000 is controlled to have a maximum gain in the front direction of the array 2000. On the other hand, the directivity of each of the other tapered slot antennas 2100 is controlled so as to have the maximum gain in a direction inclined to the center of the tapered-slot-antenna array 2000. For example, the directivity 10-4 of the tapered slot antenna 2100 located at a periphery of the tapered-slot-antenna array 2000 is controlled so as to have the maximum gain in a direction inclined to the center of the tapered-slot-antenna array 2000.

Figure 11:
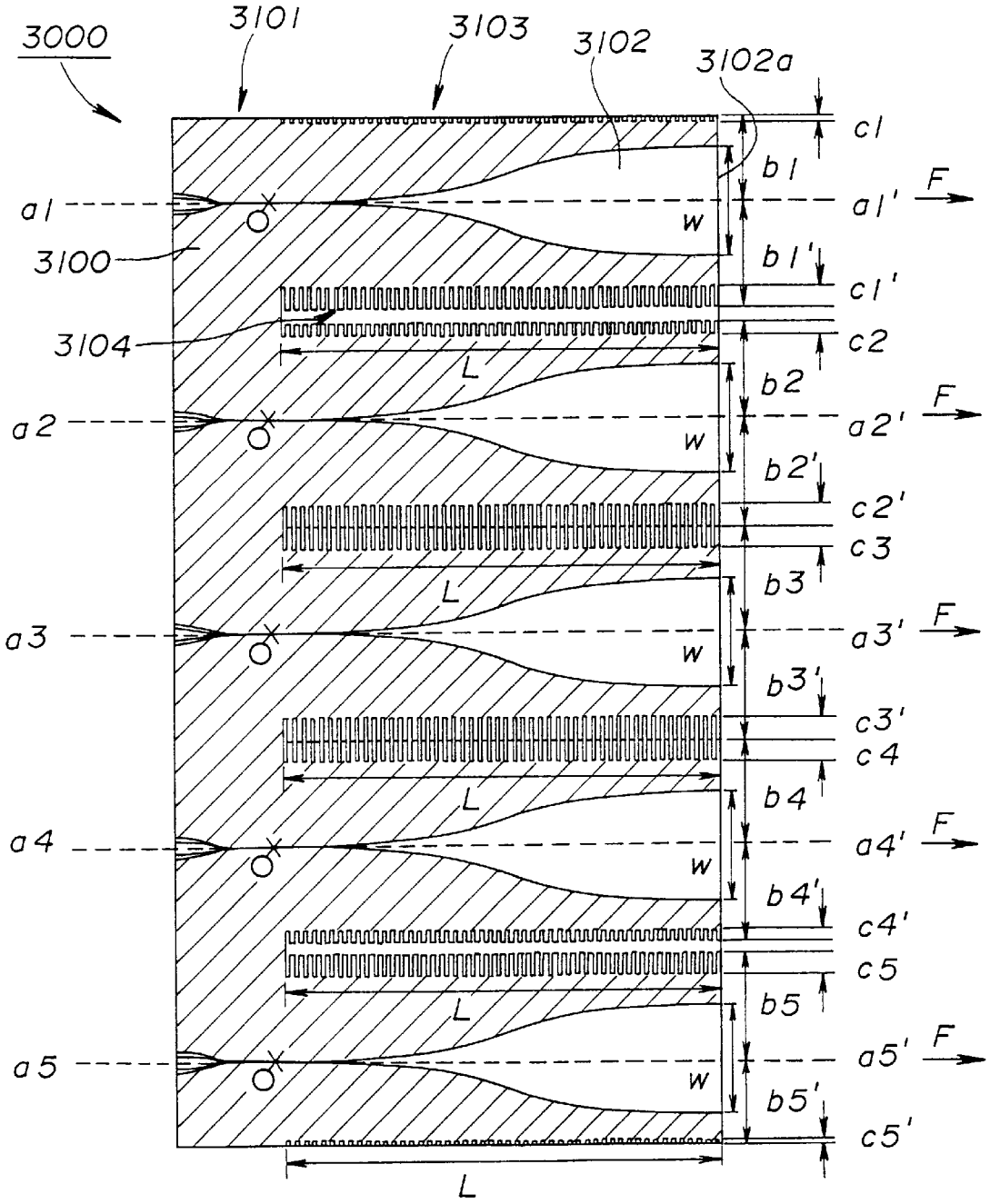
FIG. 11 shows a plan view of a tapered-slot-antenna array in a sixth embodiment of the present invention.

FIG. 11 shows a plan view of a tapered-slot-antenna array in a sixth embodiment of the present invention. This tapered-slot-antenna array 3000 is formed as a result of tapered slot antennas 3100 being arranged with an equal pitch. That is, the distance between the axes a1–a1', a2–a2' of the adjacent antennas, the distance between the axes a2–a2', a3–a3' of the adjacent antennas, the distance between the axes a3–a3', a4–a4' of the adjacent antennas, and the distance between the axes a4–a4', a5–a5' of the adjacent antennas are equal to each other. The antennas 3100 of the array 3000 are formed in a dielectric substrate 3101. The dielectric substrate 3101 includes a sheet of Kapton having a thickness of 50 $\mu$m and a layer of copper having a thickness of 5 $\mu$m laminated on the Kapton sheet. A tapered slot pattern 3102 of each antenna 3100 is formed as a result of the copper layer being partially eliminated (as shown in FIG. 1 of the above-mentioned prior application Ser. No. 08/870,676). An antenna aperture 3102*a* is located at the extending end of the tapered slot pattern 3102. The design frequency of the antenna 3100 is 60 GHz, the antenna length (L) is 20 mm, and the aperture width (W) is 5 mm. In each antenna 3100, the tapered slot pattern 3102 is symmetrical with respect to a respective one of the axes a1–a1', a2–a2', a3–a3', a4–a4' and a5–a5'. Further, the axes a1–a1', a2–a2', a3–a3', a4–a4' and a5–a5' are parallel to each other and perpendicular to the end surface S of the dielectric substrate 3101 on which the apertures 3102*a* are present. Further, the front directions (F) of the respective antennas 3100 are the same as each other.

Each tapered slot antenna 3100 has corrugated structures 3103 and 3104. In the corrugated structures (as shown in FIG. 18 of the above-mentioned prior application Ser. No. 08/870,676), the copper layer is eliminated periodically rectangularly at the two sides of the antenna 3100.

In the respective antennas 3100, the widths b3, b3' of the antenna 3100 positioned at the center of the array 3000 are symmetrical with respect to the axis a3–a3' of the antenna and the length c3 of the rectangular slits of the corrugated structure 3103 is axially symmetrical to the length c3' of the rectangular slits of the corrugated structure 3104, while in each of the other antennas 3100, respective ones of the widths b1, b1', the widths b2, b2', the widths b4, b4', and the widths b5, b5' are asymmetrical with respect to a respective one of the axes a1–a1', a2–a2', a4–a4' and a5–a5', and a respective one of the length c1, the length c2, the length c4 and the length c5 of the rectangular slits of the corrugated structures 3103 is axially asymmetrical to a respective one of the length c1', the length c2', the length c4' and the length c5' of the rectangular slits of the corrugated structures 3104, so that the antenna has a gain distribution extending in a direction inclined to the center of the array 3000. Specifically, the antenna widths are such that b1=4 mm, b1'=5 mm, b2=4.5 mm, b2'=5 mm, b3=5 mm, b3'=5 mm, b4=5 mm, b4'=4.5 mm, b5=5 mm, and b5'=4 mm. The lengths of the rectangular slits of the corrugated structures 73, 74 are such that c1=0.3 mm, c1'=1 mm, c2=0.6 mm, c2'=1 mm, c3=1 mm, c3'=1 mm, c4=1 mm, c4'=0.6 mm, c5=1 mm, and c5'=0.3 mm.

Although each of the corrugated structures formed at the two sides of the antenna 3100 located at the center of the array 3000 seems to be in contact with the corrugated structure of a respective one of the two adjacent antennas 3100 in FIG. 11, each of the corrugate structures formed at the two sides of the antenna 3100 located at the center of the array 3000 is apart from the corrugated structure of a respective one of the two adjacent antennas 3100 by a distance on the order of 100 $\mu$m, actually. Thus, each of the corrugated structures formed at the two sides of the antenna 3100 located at the center of the array 3000 is prevented from being electrically connected with the corrugated structure of a respective one of the two adjacent antennas 3100.

Figure 12:
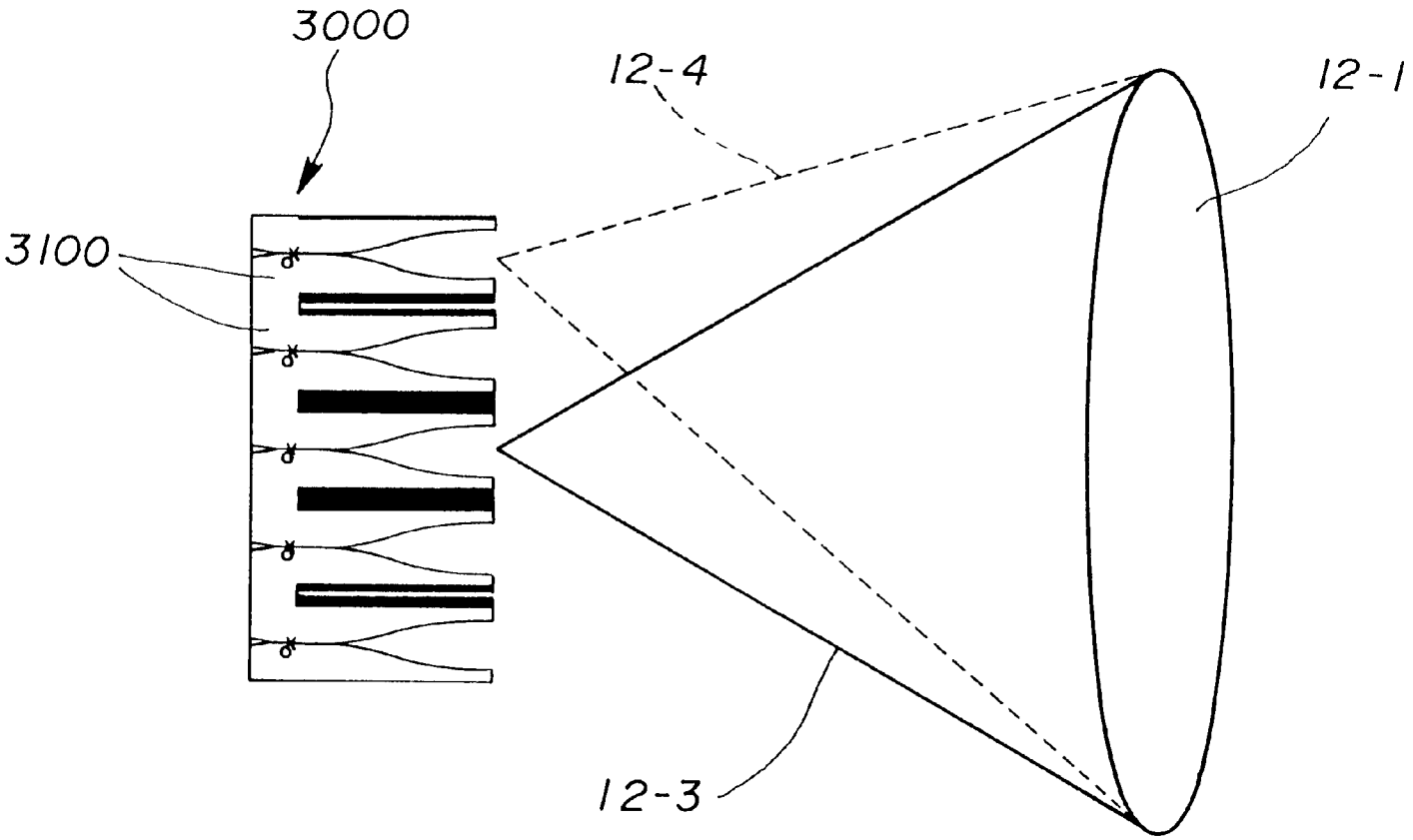
FIG. 12 shows a general arrangement of an example of a combination of the tapered-slot-antenna array shown in FIG. 11 and an optical element.

FIG. 12 shows a general arrangement of an example in which the tapered-slot-antenna array 3000 shown in FIG. 11 is combined with an optical element 12-1. As shown in the figure, the directivity 12-3 of the tapered slot antenna 3100 located at the center of the tapered-slot-antenna array 3000 is controlled to have a maximum gain in the front direction of the array 3000. On the other hand, the directivity of each of the other tapered slot antennas 3100 is controlled so as to have a maximum gain in a direction inclined to the center of the tapered-slot-antenna array 3000. For example, the directivity 12-4 of the tapered slot antenna 3100 located at a periphery of the tapered-slot-antenna array 3000 is controlled so as to have a maximum gain in a direction inclined to the center of the tapered-slot-antenna array 3000.

Figure 13:
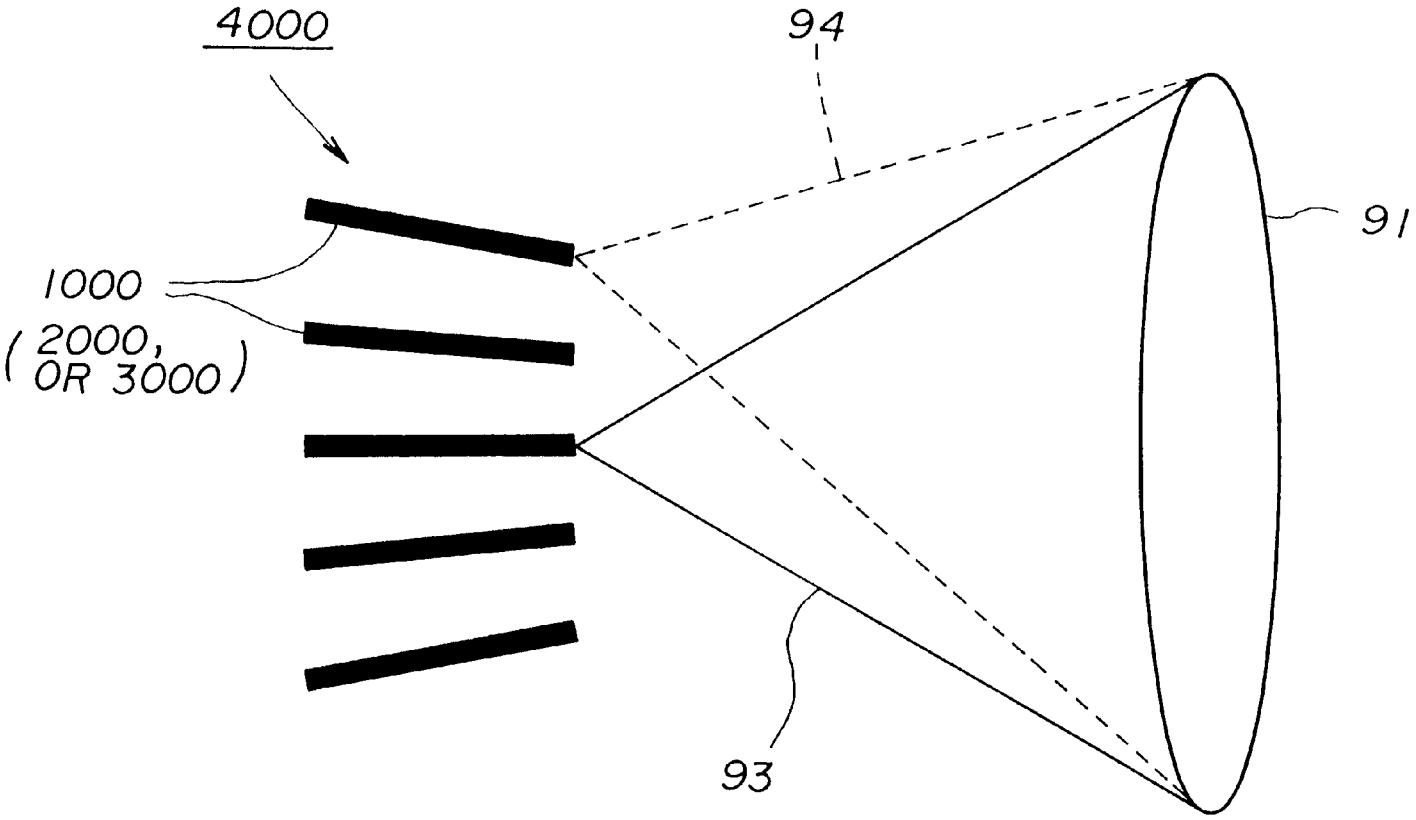
FIG. 13 shows a general arrangement of an example of a combination of a two-dimensional antenna array in a seventh embodiment of the present invention and an optical element.

FIG. 13 shows a general arrangement of an example of a combination of a two-dimensional antenna array 4000 in a seventh embodiment of the present invention and an optical element 91. The two-dimensional antenna array 4000 is formed as a result of a plurality of tapered-slot-antenna arrays 1000, 2000 or 3000 shown in FIG. 7, 9 or 11 being arranged to a substrate (not shown in FIG. 13) so that each tapered-slot-antenna array 1000, 2000, or 3000 extends in a direction perpendicular to the substrate. In FIG. 13, a cross-sectional view of each tapered-slot-antenna array 1000, 2000 or 3000 is shown. As shown in FIG. 13, the tapered-slot-antenna array 1000, 2000 or 3000 located at the center of the two-dimensional antenna array 4000 is oriented so that the directivity 93 of the tapered-slot-antenna array 1000, 2000 or 3000 located at the center of the two-dimensional antenna array 4000 has a maximum gain in the front direction of the two-dimensional antenna array 4000. On the other hand, each of the other tapered-slot-antenna arrays 1000, 2000 or 3000 is oriented so that the directivity of the tapered-slot-antenna array 1000, 2000 or 3000 has a maximum gain in a direction inclined to the center of the two-dimensional antenna array 4000. For example, the tapered-slot-antenna array 1000, 2000 or 3000 located at a periphery of the two-dimensional antenna array 4000 is oriented so that the directivity 94 of the tapered-slot-antenna array 1000, 2000 or 3000 located at the periphery of the two-dimensional antenna array 4000 has a maximum gain in a direction inclined to the center of the two-dimensional antenna array 4000.

In each of the above-described embodiments, the antenna is formed in the dielectric substrate, which includes the dielectric sheet (sheet of Kapton) and the layer of conductor (copper), the tapered slot antenna being formed in the conductor (copper) layer as a result of the conductor layer being partially eliminated, as described above. However, an embodiment of the present invention is not limited to that having the above-described structure. It is also possible that any dielectric sheet such as the sheet of Kapton is not used and an antenna includes a sheet of conductor (copper), a tapered slot antenna being formed in the conductor (copper) sheet as a result of the conductor sheet being partially eliminated. In this case, the shape of the conductor sheet may be the same as the copper layer in each of the above-described embodiments.

The present invention is not limited to the above-described embodiments, and variations and modifications may be made without departing from the scope of the present invention.

According to the present invention, it is easy to control the directivity of a tapered slot antenna in a design level. In fact, according to the present invention, merely by changing the length of rectangular slits of the corrugated structure and/or changing the width on one side of the antenna (the width between the axis of the antenna and one edge of the antenna), the directivity can be controlled arbitrarily, without changing a basic design of the antenna, that is, without changing the front direction of the antenna with respect to the end surface of the substrate on which the aperture of the antenna is present, and also, without changing the shape of the tapered slot pattern. In the cases of the arrangements disclosed in Japanese Laid-Open Patent Application Nos.5-206724 and 5-315833, it is difficult to control the directivity of the antenna in a design level because the basic design of the antenna is changed. In fact, in the arrangements disclosed in Japanese Laid-Open Patent Application Nos.5-206724 and 5-315833, the front direction of the antenna is oblique to the direction perpendicular to the end surface of the substrate on which the aperture of the antenna is present, and also, the shape of tapered slot pattern is not symmetrical with respect to the axis of the antenna.

The contents of the basic Japanese Patent Application Nos.9-216787 and 9-264644, filed on Aug. 11, 1997 and Sep. 29, 1997, respectively, are hereby incorporated by reference.

What is claimed is:

1. A tapered slot antenna comprising:

a thin conductor, in which a tapered slot pattern is formed as a result of a slot width of a slotline being widened gradually; and corrugated structures provided at two sides of said thin conductor, parallel to a direction in which an electromagnetic wave is radiated from said antenna, wherein the shape of said antenna is axially asymmetrical.

2. The tapered slot antenna as claimed in claim 1, wherein the corrugated structure at one side is axially asymmetrical to the corrugated structure at the other side.

3. The tapered slot antenna as claimed in claim 1, wherein one width of said antenna between the axis of said antenna and one edge of said antenna is axially asymmetrical to the other width between the axis of said antenna and the other edge of said antenna.

4. The tapered slot antenna as claimed in claim 1, wherein:

the corrugated structure at one side is axially asymmetrical to the corrugated structure at the other side; and one width of said antenna between the axis of said antenna and one edge of said antenna is axially asymmetrical to the other width between the axis of said antenna and the other edge of said antenna.

5. A tapered-slot-antenna array comprising an array of a plurality of tapered slot antennas, said array comprising:

a thin conductor, in which thin conductor tapered slot patterns are formed as a result of slot widths of slotlines being widened gradually for said plurality of tapered slot antennas, respectively; and corrugated structures provided at two sides of a portion of said thin conductor, for at least one of said plurality of tapered slot antennas, parallel to a direction in which an electromagnetic wave is radiated from said at least one of said plurality of tapered slot antennas, wherein the shape of said at least one of said plurality of tapered slot antennas is axially asymmetrical.

6. The tapered-slot-antenna array as claimed in claim 5, wherein a distance between the axes of each pair of adjacent ones of said plurality of tapered slot antennas is equal.

7. The tapered-slot-antenna array as claimed in claim 5, wherein the directivity of each of the tapered slot antennas, of said plurality of tapered slot antennas, other than the tapered slot antenna located at the central position of said tapered-slot-antenna array, has a gain distribution extending in a direction inclined to the center of said tapered-slot-antenna array.

8. A two-dimensional antenna array comprising a plurality of tapered-slot-antenna arrays provided to a substrate, wherein:

each of said plurality of tapered-slot-antenna arrays comprises an array of a plurality of tapered slot antennas and extends in a direction perpendicular to said substrate;

said array of said plurality of tapered slot antennas comprising:

a thin conductor, in which thin conductor tapered slot patterns are formed as a result of slot widths of slotlines being widened gradually for said plurality of tapered slot antennas, respectively, and corrugated structures provided at two sides of a portion of said thin conductor, for at least one of said plurality of tapered slot antennas, parallel to a direction in which an electromagnetic wave is radiated from said at least one of said plurality of tapered slot antennas, the shape of said at least one of said plurality of tapered slot antennas being axially asymmetrical;

the directivity of the tapered-slot-antenna array provided at the central position of said two-dimensional antenna array has a gain distribution extending in a front direction of said two-dimensional antenna array; and the directivity of each of the other tapered-slot-antenna arrays of said plurality of tapered-slot-antenna arrays has a gain distribution extending in a direction inclined to the center of said two-dimensional antenna array.

9. A tapered-slot-antenna array comprising:

a first tapered slot antenna comprising:

a thin conductor, in which thin conductor a tapered slot pattern is formed as a result of a slot width of a slotline being widened gradually, and corrugated structures provided at two sides of said thin conductor, parallel to a direction in which an electromagnetic wave is radiated from said antenna, wherein the shape of said antenna is axially asymmetrical; and a second tapered slot antenna comprising:

a thin conductor, in which thin conductor a tapered slot pattern is formed as a result of a slot width of a slotline being widened gradually, and corrugated structures provided at two sides of said thin conductor, parallel to a direction in which an electromagnetic wave is radiated from said antenna, wherein the shape of said antenna is axially symmetrical.

10. The tapered-slot-antenna array as claimed in claim 9, wherein the distance between the axes of each pair of adjacent ones of the tapered slot antennas is equal.

11. A tapered-slot-antenna array comprising an array of a plurality of tapered slot antennas, wherein:

the tapered slot antenna positioned at the center of said tapered-slot-antenna array comprises:

a thin conductor, in which thin conductor a tapered slot pattern is formed as a result of a slot width of a slotline being widened gradually, and corrugated structures provided at two sides of said thin conductor, parallel to a direction in which an electromagnetic wave is radiated from said antenna, wherein the shape of said antenna is axially symmetrical, and thereby, the directivity of said antenna is axially symmetrical; and each of the other tapered slot antennas of said plurality of tapered slot antennas comprises:

a thin conductor, in which thin conductor a tapered slot pattern is formed as a result of a slot width of a slotline being widened gradually, and corrugated structures provided at two sides of said thin conductor, parallel to a direction in which an electromagnetic wave is radiated from said antenna, wherein the shape of said antenna is axially asymmetrical, and thereby, the directivity of said antenna is axially asymmetrical and has a gain distribution extending in a direction inclined to the center of said tapered-slot-antenna array.

12. A two-dimensional antenna array comprising a plurality of tapered-slot-antenna arrays provided to a substrate, wherein:

each of said plurality of tapered-slot-antenna arrays comprises an array of a plurality of tapered slot antennas and extends in a direction perpendicular to said substrate;

said array of said plurality of tapered slot antennas comprising:

thin conductor, in which thin conductor tapered slot patterns are formed as a result of slot widths of slotlines being widened gradually for said plurality of tapered slot antennas, respectively, and corrugated structures provided at two sides of a portion of said thin conductor for each of said plurality of tapered slot antennas, parallel to a direction in which an electromagnetic wave is radiated from the tapered slot antenna, the shape of at least one of said plurality of tapered slot antennas being axially asymmetrical, and the shape of another of said plurality of tapered slot antennas being axially symmetrical;

the directivity of the tapered-slot-antenna array provided at the central position of said two-dimensional antenna array has a gain distribution extending in a front direction of said two-dimensional antenna array; and the directivity of each of the other tapered-slot-antenna arrays of said plurality of tapered-slot-antenna arrays has a gain distribution in a direction inclined to the center of said two-dimensional antenna array.

* * * * *